United States Patent [19]

Bode et al.

[11] Patent Number: 4,667,394

[45] **Date of Patent: * May 26, 1987**

[54] METHOD OF MAKING A COMMUTATOR RING HAVING SEGMENTS

[75] Inventors: Werner Bode, Hildesheim; Peter Franz, Diekholzen; Werner Ross, Hildesheim; Günter Schulze, Klein Elbe, all of Fed. Rep. of Germany

[73] Assignee: Robert Bosch GmbH, Stuttgart, Fed. Rep. of Germany

[ * ] Notice: The portion of the term of this patent subsequent to Sep. 16, 2003 has been disclaimed.

[21] Appl. No.: 834,138

[22] Filed: Feb. 24, 1986

Related U.S. Application Data

[63] Continuation of Ser. No. 552,977, Nov. 17, 1983, abandoned.

[30] Foreign Application Priority Data

Nov. 19, 1982 [DE] Fed. Rep. of Germany ..... 3242703

[51] Int. Cl.[4] ..... H01R 43/06

[52] U.S. Cl. ..... 29/597; 72/354; 72/370; 310/236

[58] Field of Search ..... 29/597; 72/354, 370; 310/236

[56] References Cited

U.S. PATENT DOCUMENTS

| | | | |
|---|---|---|---|
| 561328 | 10/1957 | BEX . | |
| 2,864,157 | 12/1958 | Camprubi . | |
| 3,423,819 | 1/1969 | Carlson et al. | 29/597 X |
| 3,608,350 | 9/1971 | Yamaguchi | 29/597 X |
| 3,664,012 | 5/1972 | Wilke et al. | 29/597 |
| 3,708,872 | 1/1973 | Ohuchi et al. | 29/597 |
| 3,768,295 | 10/1973 | Cudzik | 72/465 X |
| 3,958,326 | 5/1976 | Matsumoto et al. | 29/597 |
| 4,299,112 | 11/1981 | Kondo et al. | 72/352 X |
| 4,463,590 | 8/1984 | Theobald | 72/354 |

OTHER PUBLICATIONS

"Powder Metallurgy" by Kiparisov and Lieberson, published 1972, p. 221.

*Primary Examiner*—Howard N. Goldberg
*Assistant Examiner*—Joseph M. Gorski
*Attorney, Agent, or Firm*—Frishauf, Holtz, Goodman & Woodward

[57] ABSTRACT

A method of forming flanged commutator segmental rings in a single power stroke by cold-extrusion which assures full formation of the inner ribs which become commutator segments, so that the segments will anchor well and resist centrifugal force at high rotational speed. The extrusion apparatus has an inner rib-forming die (18) and an outer ring-shaped flange-forming die (16). In the first stage of the power stroke, a ring-shaped blank (1) is formed into a flange precursor and a shaft portion (24) with inner ribs. In the second stage of the power stroke, the ring-shaped die (16) forms the flange (4) while the rib-forming die (18) forms a longer shaft (3) with a full complement of inner ribs (5) and a counter-punch (13) maintains pressure.

7 Claims, 7 Drawing Figures

METHOD OF MAKING A COMMUTATOR RING HAVING SEGMENTS

This is a continuation of U.S. Ser. No. 552,977, now abandoned, filed 11/17/83.

Cross reference to related applications, assigned to the assignee of the present application, the disclosures of which are hereby incorporated by reference:

U.S. Ser. No. 554,199, filed 11/22,83, BODE et al "METHOD OF MAKING COMMUTATOR RINGS" (claiming priority of German Appln. P 32 43 191.0 of 11/23/82;

U.S. Ser. No. 552,984, filed 11/17/83, FRANZ et al; now U.S. Pat. No. 4,611,391 "COMMUTATOR RING MANUFACTURING METHOD, AND APPARATUS" (claiming priority of German Appln. P 32 42 702.6 of 11/18/82;

The present invention relates to a method of manufacturing commutator rings, and more particularly to the manufacture of a commutator ring with a circumferential flange and multiple inwardly projecting ribs from a blank metal ring by cold-extrusion.

BACKGROUND

It is known to use cold-extrusion in the manufacture of a commutator segmental ring. In the commutator segmental rings made according to this conventional method, the outline of the inner ribs comprising the commutator segments is not fully formed, at least in one end section. That stems from, for example, impaired raw material flow caused by friction at the beginning of the forming process and from inadequate power build-up for overcoming these frictional influences. These conventional commutator segmental rings therefore have the disadvantage that the anchoring means formed on the inner end of each commutator segment are not created with the same cross section over the whole length of the commutator segment. In the end sections of the individual segments there is insufficient material available for this purpose. With their anchoring means thus configured, the segments cannot be fastened along their entire length in the insulating hub of the commutator against centrifugal force. This causes the segments to rip out of the insulating hub, particularly in the case of commutators in fast-running electrical machines.

THE INVENTION

It is therefore an object of the method of the present invention to produce commutator segmental rings with inner ribs which exhibit a full cross section throughout their entire length. The present method permits the anchoring means, which, for example, project circumferentially of a commutator ring into segmental grooves, to fully form along the entire length of the commutator segments, the commutator segments to anchor along their length in the insulating hub of the commutator, and such commutators to be used as amply resistant to centrifugal force in high-speed electrical machines.

A further advantage of the method of this invention is that it can be carried out with a forming apparatus using a multi-part die in which a commutator segmental ring can be formed from a ring-shaped blank with relatively light power consumption in a single power stroke.

In accordance with an embodiment of the invention, the power stroke is separated into two stages, with a pause between them. In the first stage, a circular die and a toothed rib-forming die disposed longitudinally within it cooperate to form a segmental ring with a relatively thick annular flange and a relatively short hollow cylindrical shaft having radial inwardly pointing ribs. A counterpunch limits the length of the short shaft. After a time period of stationary dies, in the second stage, the dies travel further in the same direction to thin the flange and transfer material from the flange into a lengthened shaft by extrusion. The counterpunch pressing against the toothed rib-forming ddie limits the length of the shaft.

In a second version of the method, two stages of the power stroke are also employed. In the first stage, a similar thick flange and short shaft are formed, but by backward extrusion and with the rib-forming die acting from below. In the second stage, the ring-shaped die transfers material from the flange into a lengthened shaft further by backward extrusion, and the shaft is formed in an annular space between the ring die and the rib-forming die. The counterpunch limits the length of the short shaft and the shaft, respectively.

As before, a counter-punch maintains sufficient pressure on the raw material to assure that it penetrates all portions of the die and fully forms all portions of the commutator segmental ring.

This method offers a number of advantages. Particularly advantageous is the fact that by the end of the first stage of the power stroke, the blank has been formed into not only the flange but also the root of a shaft with fully configured inner ribs. The counter-punch acts against the part of the die forming the inner ribs so as to limit the length of the rib section and to eject the commutator segment ring from the forming apparatus. Another advantage is that the method of the invention permits transformation of the blank into a commutator segmental ring through either forward or backward extrusion.

DRAWINGS

DETAILED DESCRIPTION

Figure 1:
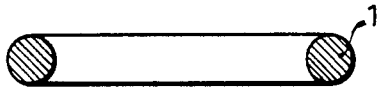
FIG. 1 is a cross-sectional view of a ring-shaped blank for a commutator segmental ring.
Figure 2:
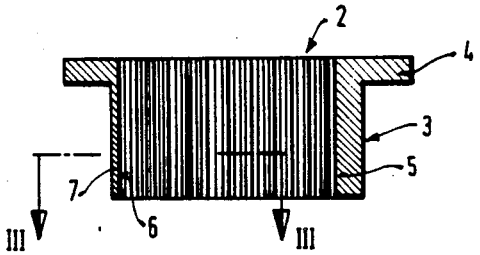
FIG. 2 is a longitudinal cross section of a commutator segmental ring.
Figure 3:
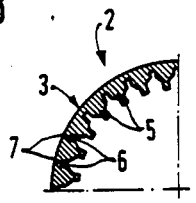
FIG. 3 is a partial cross section of a commutator segmental ring along line III—III of FIG. 2.

A blank 1 for a commutator segmental ring 2 of a commutator is made of a material adapted for commutators, for example, copper. The blank 1 has the form of a ring with a round or rectangular cross section. The blank 1 can be a slice from a hollow cylinder. Equally well, the blank 1 can be formed from a slice of rod which has been bent into a ring.

For cold-forming of the blank 1 into a commutator segmental ring 2 in accordance with the invention, a ring-shaped blank 1 is turned into a hub or shaft portion 3 with a flange 4. A die on the inner side of the shaft 3 of the blank 1 produces a plurality of axial inner ribs, which are arranged at equal angular intervals from each other. The inner ribs form commutator segments 5 which are separated from each other by segment grooves 6 and connected only by small cross pieces 7.

The cold-forming of the blank 1 into the commutator segmental ring 2 is accomplished in a multi-part forming apparatus in an operation with two stages of the single power stroke. Between the two stages of the power stroke, there is provided a short pause of adjustable duration.

Figure 4:
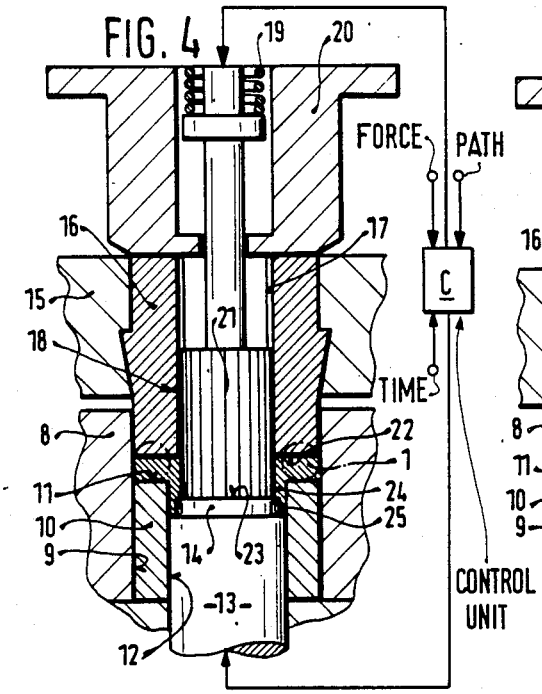
FIG. 4 is a first embodiment of a forming apparatus for forward extrusion at the end of the first stage of the power stroke.
Figure 5:
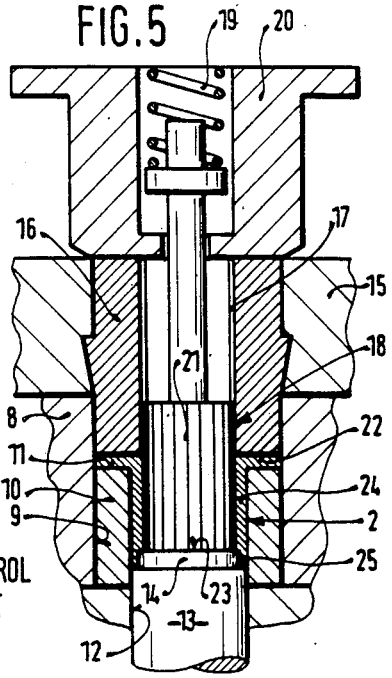
FIG. 5 is that same forming apparatus at the end of the second stage of the power stroke.

A first embodiment of the forming apparatus for forward extrusion is depicted in FIGS. 4 and 5, of which FIG. 4 shows the end of the first stage and FIG. 5 shows the end of the second stage of the power stroke.

A lower punch plate 8 is provided with a longitudinal bore 9, in which a hollow cylindrical extrusion matrix 10 is inserted. The face 11 of the matrix 10 corresponds to the form of the flange 4 of the commutator segmental ring 2 to be formed. Into the bore 12 of the matrix 10 projects a lower punch, which serves as a counter-punch 13 and as an ejector. The counter-punch 13 has a short cylindrical end section 14 with a somewhat smaller diameter. The other end of the counter-punch 13 abuts, in a known manner not illustrated here, the control piston of a conventional adjustable, elastic control means (not shown), such as a hydraulic counter-pressure, or a gas spring.

In a middle punch plate 15, which is movable with respect to the lower punch plate 8, is fastened a ring die 16. Its outer diameter corresponds to the diameter of the bore 9 of the lower punch plate 8. The ring die 16 has an inner bore provided with longitudinal teeth 17. The teeth 17 have the negative of configuration of the commutator segments 5. In the inner, toothed bore of the ring die 16 an upper punch which acts as a die 18 is introduced. It is supported on a spring arrangement 19 of a tool mechanism which is connected to an upper punch plate 20. The middle and upper punch plates 15 and 20, respectively, are movable together and relative to each other. The die 18 is provided at the periphery of its forming section with teeth at equal angular intervals from each other, whose configuration corresponds to the segment grooves 6 of the commutator segmental ring 2 and which extend between the teeth 17 of the ring die 16.

OPERATION

In FIGS. 4 and 5, a forming apparatus is shown. In the initial position of the apparatus, the middle and upper punch plates 15 and 20 and of the ring-shaped die, 16 and rib-forming die 18 which together make up the divided forming die, are in a raised position so that the blank 1 can be inserted. The rib-forming die 18 is thus far drawn back behind the face 22 of the ring-shaped die 16. The counter punch 13 is pushed so far into the central bore 12 of the matrix 10 that the face 23 of the counter-punch projects past the fase 11 of the matrix 10 by the length of a shaft portion 24 to be formed. The blank 1 is placed in the central bore 9 of the lower punch plate 8 so that it rests on the face 11 of the matrix 10 which acts as a workpiece support.

During the first stage of the power stroke, the middle and upper punch plates 15 and 20, along with the ring-shaped die 16 and the rib-forming die 18, are moved onto the blank 1. During forward extrusion, the ring-shaped die 16 and the rib-forming die 18 move in the same direction. When the ring-shaped die 16, which is introduced into the central bore 9 of the lower punch plate 8, rests on the blank 1, the die 16 stops and only the rib-forming die 18 moves further into the blank 1 until the die 18 rests on the face 23 of the counter-punch 13 and the upper punch plate 20 sits on the ring-shaped die 16 or on the middle punch plate 15. The rib-forming die 18 and the counter-punch 13 are pressure-sealed against each other in this position in a known manner which need not be further described. The ring-shaped die 16 then moves further into the bore 9 with respect to the stationary rib-forming die 18 and, in doing so, transforms the blank 1. The surplus material of the blank 1 is forced into the matrix 10 until it encounters the counter-punch 13 and forms a shaft or hub portion 24 for the commutator segmental ring 2. In a set period of time, the outline of the inner ribs fully forms along the length of the rib-forming die 18 in the precursor of flange 4 and in the shaft portion 24 because there is no frictional orce to overcome by material flow. During this time period, no die movement takes place, in that the first stage of the power stroke has already ended (FIG. 4). By its acceptance of extruded material, the narrow annular gap 25, formed between the end portion 14 of the counter-punch 13 and the central bore 9 of the matrix 10, facilitates the full formation of the outline of the inner ribs, particularly in the end portion of the shaft 3 of the commutator segmental ring 2 at the end of the first stage of the power stroke.

In the subsequent second stage of the power stroke, the counter punch 13 is moved back into its fixed, lower end position which limits the length of the shaft 3 of the commutator segmental ring 2. The middle and the upper punch plates 15 and 20, respectively, are moved down onto the lower support plate 8 until the middle punch plate 15 rests on the lower punch plate 8. The ring-shaped die 16 which moves along, has then completed formation of the flange 4. The rib-forming die 18, still propelled by the force of the spring apparatus 19 and pulled by the frictional force between the extruded material and the teeth 21 of rib-forming die 18, moves to the renewed position at the face 23 of the counter-punch 13 in the matrix 10. Thus, the shaft 3 forms with a full profile of ribs. Only then is the end of the power stroke reached.

The apparatus is then opened and the commutator segmental ring 2 is pushed into a removal position by the counter-punch 13 which acts as an ejector during its return trip to its initial position.

The commutator segmental ring 2 can then, in a known manner which need not be described here, be freed from the rim formed in the annular gap 25 and provided with anchoring means and with an insulating hub, in which the commutator segments 5 are anchored. Then the commutator segments 5 are separated by removal of the cross pieces 7 and the connecting lugs formed in the flange 4 are provided with wire receiving slots to complete the commutator.

Figure 6:
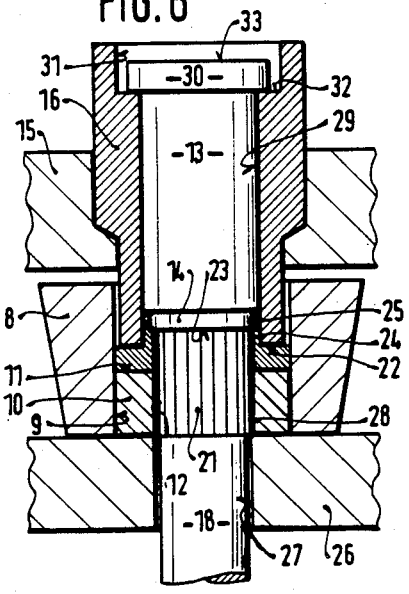
FIG. 6 is a second embodiment of a forming apparatus for backward extrusion at the end of the first stage of the power stroke.
Figure 7:
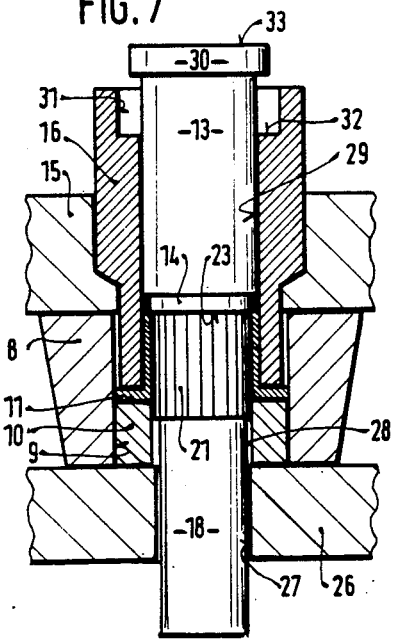
FIG. 7 is that same forming apparatus at the end of the second stage of the power stroke.

FIGS. 6 and 7 depict in a simplified manner a second embodiment of the forming apparatus, this time for backward extrusion. Analogously, FIG. 6 depicts the end of the first stage and FIG. 7 the end of the second stage of the power stroke. Insofar as the parts correspond with those of the first embodiment of FIGS. 4 and 5, the parts have been assigned the same reference numbers.

A guide plate 26 is provided with a longitudinal bore 27 in which is introduced a longitudinally movable lower punch which acts as a rib-forming die 18. The upper end of the die 18 is provided with teeth 21 in the configuration of the segment grooves 6. On the lower face of the die 18 is again disposed the apparatus driving spring arrangement 19 (not shown).

Atop the guide plate 26 is fastened the lower punch plate 8, in whose central bore 9 a hollow cylindrical matrix 10 is placed. The central bore 12 of the matrix 10 is provided with longitudinally running teeth 28 whose profile corresponds to that of the commutator segments 5. The face 11 of the matrix 10 again forms the workpiece support.

The ring-shaped die 16, arranged securely in the middle punch plate 15, moves oppositely to the rib-forming die 18 during backward extrusion. The dies 16 and 18 comprise the multi-part die arrangement. An upper punch which serves as a counter-punch 13 is introduced into the central bore 29 of the ring-shaped die 16. The counter-punch 13 has at its lower end an end portion 14 with a smaller diameter. The upper end of the counter-punch 13 is provided with a flange 30 which rides in a widened end section 31 of the longitudinal bore 29. The end section 31 joins the bore 29 at a circular shoulder 32. On the upper face 33 of the flange 30, the control piston of an adjustable, elastic control means rests in a known manner which need not be further described here.

In the initial position of the forming apparatus, the middle punch plate 15 is withdrawn from the lower punch plate 8 into the former's highest position, together with the ring-shaped die 16 and the counter-punch 13, 30 which rides inside the ring-shaped die 16, 29, 31. The counter-punch 13 therefore rests with its flange 30 on the ring-shaped shoulder 32 of the ring-shaped die 16. The ring-shaped shoulder 32 limits the movement of the counter-punch 13 with respect to the ring-shaped die 16 in the direction of the matrix 10. The axial distance between the ring-shaped shoulder 32 and the face 22 of the ring-shaped die 16, together with the length of the counter-punch 13 between the flange 30 and the face 23 on the end portion 14 determine the length of the shaft portion 24 which is formed in the first stage of the power stroke. The rib-forming die 18 extends in its initial position into the matrix 10 so that the face of the die 18 does not project out over of the face 11 of the matrix 10.

OPERATION

The blank is placed in the bore 9 of the lower punch plate 8 so that it rests on the workpiece support face 11 of the matrix 10. During the first stage of the power stroke, the rib-forming die 18 is pushed out of the matrix 10 and through the blank, while the middle punch plate 15 and the ring-shaped die 16 are moved down onto the lower punch plate 8. The ring-shaped die 16 dips a predetermined distance into the bore 9 and transforms the blank into a precursor of the flange 4 of the commutator segmental ring 2. The surplus material of the blank flows meanwhile into the bore 29 of the ring-shaped die 16 until it encounters the teeth 21 of the rib-forming die 18 and the counter-punch 13, whose face 23 is pressure-sealed against the face of the rib-forming die 18, and form the shaft portion 24. The complete profile of the inner ribs 5 between the teeth 21 of the rib-forming die 18 inside the flange precursor and the shaft portion 24 is formed. At the end of the first stage of the power stroke (FIG. 6), the punch and dies 13, 16 and 18 become stationary for a predetermined period of time. During this time period, the material flow is facilitated by the fact that only a small part of material of the blank 1 can flow into the narrow annular space 25 at the periphery of the end portion 14 of the counter-punch 13.

Next, the second stage of the power stroke begins. The ring-shaped die 16 is pressed further on to the precursor of the flange 14 until the middle punch plate 15 rests on the lower punch plate 8. Meanwhile, the counter-punch 13 is moved back into its position in the bore 29 which limits the length of the shaft 3, and is held there. The rib-forming die 18, is moved to a pressure-sealed position against the face 23 of the counter-punch 13, all under the influence of the force of the spring arrangement 19 of the apparatus driving means and pulled by the frictional force between the extrusion material and the teeth 21 of rib-forming die 18. The shaft 3 of the commutator segmental ring 2 forms with the full profile of inner ribs for the commutator segments 5. Thus, the end of the second stage, and of the entire power stroke, is reached (FIG. 7).

As before, the forming apparatus is opened and the commutator segmental ring 2 is pushed out of the bore 29 of the ring-shaped die 16 into a removal position by the counter-punch 13 which acts as an ejector during its return to its initial position.

The commutator segmental ring 2 is turned into a completed commutator as was described above in relation to the first embodiment of the invention.

The time interval between two stages of the power stroke is controlled by a control unit C, shown only in FIG. 4, for example at a fixed time, or based on stroke length, or extrusion force, communicated to the control unit by sensors of conventional construction.

Various changes and modifications may be made, and any features described may be used with any of the others of the respective embodiments, within the scope of the inventive concept.

We claim:

1. A method of making a generally cylindrical commutator segmental ring (2), with an inner and an outer diameter, a length perpendicular to said diameters, two ends, a plurality of axially extending inner ribs (5) and a flange (4) on one end, by cold-extrusion of a ring-shaped blank (1), comprising cold-extruding the blank (1) by performing the steps of:

placing the blank (1) in a forming apparatus having a hollow, cylindrical extrusion matrix (10) and a multi-part die with axially relatively movable inner (18) and outer (16) dies and a counterpunch (13), said inner die (18) having a plurality of longitudinally continuous radial teeth (21) thereon and an end face resting under pressure against an end face (23) of said counterpunch (13);

axially moving said inner die (18) substantially through the center of said ring-shaped blank (1);

in a first stage of a single power stroke of said apparatus, said die parts (16,18,13) each moving in only a single direction during said single power stroke, flattening said blank (1) between said outer die (16) and an end face of said extrusion matrix (10), thereby forming the blank (1) into an intermediate form having a thick flange and an attached short shaft portion (24), the length of said short shaft portion (24) being limited by said counterpunch (13) and the inner diameter of said short shaft portion (24) being radially limited by said inner die (18);

interrupting movement of said dies (16, 18) for a selected, adjustable period of time after said first stage of said single power stroke, flowing material of said blank into interstices between said teeth (21) of said inner die (18), thereby fully forming the cross-section of said axial inner ribs (5); and in a second stage of said single power stroke, resuming axial movement of said outer die (16) against said thick flange of said intermediate form while extending said inner die (18) through said intermediate form and retracting said counterpunch (13), thereby extruding material from said flange, lengthening said shaft portion (24), and lengthening said axially extending inner ribs (5) therein.

2. A method according to claim 1, further comprising facilitating the formation of a fully formed profile of inner ribs (5) along the entire length of a commutator segmental ring (2) during the first stage of the power stroke by forming a short ring-shaped extension on a face of the shaft portion of the intermediate form, said extension projecting beyond a face of the inner die (18) of the multi-part die, and surrounding a smaller-diameter end portion (14) of the counterpunch (13), said end portion (14) being pressure-sealed against the face of said inner die (18).

3. A method according to claim 1, wherein said step of interrupting die movement for an adjustable period of time further includes providing a die control means and adjusting said period of time on said control means to be, selectively, time-dependent, path-dependent, or force-dependent.

4. A method according to claim 1, further comprising the steps of opening the forming apparatus and pressing said counterpunch (13) against the commutator segmental ring (2) as an ejector therefor, thereby moving the commutator segmental ring (2) to a predetermined removal height.

5. A method according to claim 1, wherein said inner die (18) is a rib-forming die and said outer die (16) is a flange-forming die, said single power stroke comprising forward extrusion of the blank (1) with, the inner rib-forming die (18) riding inside the outer flange-forming die (16), both dies moving in the same direction during the power stroke, and said counterpunch (13) being introduced into a blank-receiving area.

6. A method according to claim 1, wherein said inner die (18) is a rib-forming die and said outer die (16) is a flange-forming die, said single power stroke comprising backward extrusion of the blank (1) with, the inner rib-forming die (18) being introduced into a blank-receiving area and moving during the power stroke in a direction opposite to the direction in which the outer flange-forming die (16) is moved.

7. A method as set forth in claim 1, including prior to said first stage of said single power stroke, bringing said inner die (18) through the blank (1) and placing said inner die (18) under adjustable elastic pressure against an end face (23) of the counterpunch (13);

said outer die (16) having an annular bearing surface (22), pressing said annular bearing surface, during said first power-stroke stage, against the blank while the inner die (18) and the counterpunch (13) remain stationary;

and, after said interruption between said first and second power-stroke stages, in said second power-stroke stage, retracting the counterpunch (13) to a position corresponding to the desired length of the commutator segmental ring (2), moving the outer die (16) a distance corresponding to the difference between the thickness of the flange of the intermediate form and the thickness of the flange (4) of the commutator segmental ring (2), said flange (4) of said ring being thinner than said flange of said intermediate form, and moving the inner die (18) along a path of the counterpunch (13) to a position corresponding to the length of the commutator segmental ring (2).

* * * * *